US006519813B1

(12) United States Patent
Lin et al.

(10) Patent No.: US 6,519,813 B1
(45) Date of Patent: Feb. 18, 2003

(54) FIXING DEVICE FOR A PEN CLIP

(76) Inventors: Wei-Jong Lin, 1F, No. 25, Lane 280, Shin-Yih Rd., Lu-Jou City, Taipei Hsien (TW); Chang-Yu Lin, 3F-5, No. 91, Ta-Shun 1st Rd., Kaohsing (TW)

( * ) Notice: Subject to any disclaimer, the term of this patent is extended or adjusted under 35 U.S.C. 154(b) by 0 days.

(21) Appl. No.: 09/969,830

(22) Filed: Oct. 4, 2001

(51) Int. Cl.[7] ..... B43K 25/00

(52) U.S. Cl. ..... 24/11 F; 24/11 HC; 24/11 R; 401/202

(58) Field of Search ..... 24/11 R, 11 F, 24/11 FE, 10 R, 11 CT, 11 HC, 3.1, 3.12; 401/104, 202

(56) References Cited

U.S. PATENT DOCUMENTS 1,838,747 A * 12/1931 Deli ..... 24/11 F
2,460,728 A * 2/1949 Aversa ..... 24/11 F
3,842,466 A * 10/1974 Katz et al. ..... 24/11 F
4,706,341 A * 11/1987 Celaries ..... 24/11 R
5,427,464 A * 6/1995 Nakagawa ..... 401/202
5,632,565 A * 5/1997 Yamaguchi ..... 401/202

* cited by examiner

*Primary Examiner*—Robert J. Sandy
(74) *Attorney, Agent, or Firm*—Bacon & Thomas, PLLC

(57) ABSTRACT

A fixing device for a pen clip which contains a fixing cap, an upper casing, a fixing clip, an adjusting assembly and a lower casing. The upper casing is a hollow tube and has a trumpet-shaped mouthpiece (top wide while bottom narrow) for receiving the fixing cap in place. The fixing cap has an indentation to receive the fixing clip. A screw is tightened from the inner side of the adjusting assembly to the fixing cap. The trumpet-shaped mouthpiece of the upper casing will be expanded by the screw for a tight connection with the fixing clip so that the fixing clip is situated between the casing and the fixing cap and won't be easily disconnected. Accordingly, an additional fixing effect and a convenient application is achieved.

7 Claims, 6 Drawing Sheets

FIXING DEVICE FOR A PEN CLIP

BACKGROUND OF THE INVENTION

1. Field of the Invention

The present invention relates to a fixing device for a pen clip, and more particularly, to a device in which the casing has a trumpet-shaped mouthpiece while an indentation is formed at the rim of a fixing cap so that a fixing clip can be tightly fixed between the upper casing and the fixing cap and won't be easily disconnected. Moreover, it has an aesthetically appealing appearance.

2. Description of the Prior Art

In the conventional fixing clip of a pen, a metal clip with proper size is inserted in a preset position of the pen while the connection place is glued to strengthen the fixing effect. This kind of fixing way can reach a basic fixing effect. However, it will be easily disconnected after used for a long period. The other one is that the fixing clip is formed together with the pen in the injection molding way so that the fixing clip won't be easily disconnected from the pen casing. However, the plastic material has its own tension limit. The fixing clip is often broken off at the connection place due to an excessive force or an improper use.

SUMMARY OF THE INVENTION

It is a primary object according to the present invention to eliminate the aforementioned drawbacks and to provide a fixing device for a pen clip which contains a fixing cap, an upper casing, a fixing clip, an adjusting assembly 4 and a lower casing. The upper casing 2 is a hollow tube and has a trumpet-shaped mouthpiece (wide at the top while narrow at the bottom) for receiving the fixing cap 1 in place. The fixing cap has an indentation to receive the fixing clip. A screw is tightened from the inner side of the adjusting assembly 4 to the fixing cap 1. The trumpet-shaped mouthpiece of the upper casing will be expanded by the screw for a tight connection with the fixing clip so that the fixing clip is situated between the casing and the fixing cap and won't be easily disconnected. Accordingly, an additional fixing effect and a convenient application is achieved.

BRIEF DESCRIPTION OF THE DRAWINGS

The drawings disclose illustrative embodiments of the present invention which serves to exemplify the various advantages and objects hereof, and are as follows.

DETAILED DESCRIPTION OF THE PREFERRED EMBODIMENT

Figure 1:
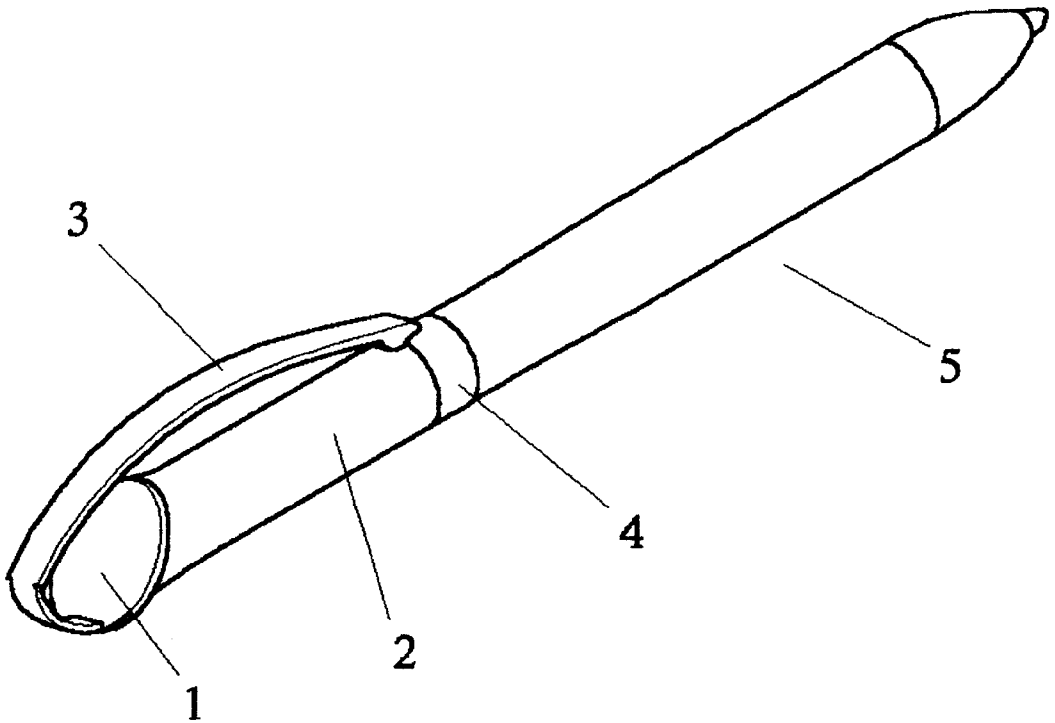
FIG. 1 is a perspective view of a preferred embodiment of the present invention.
Figure 2:
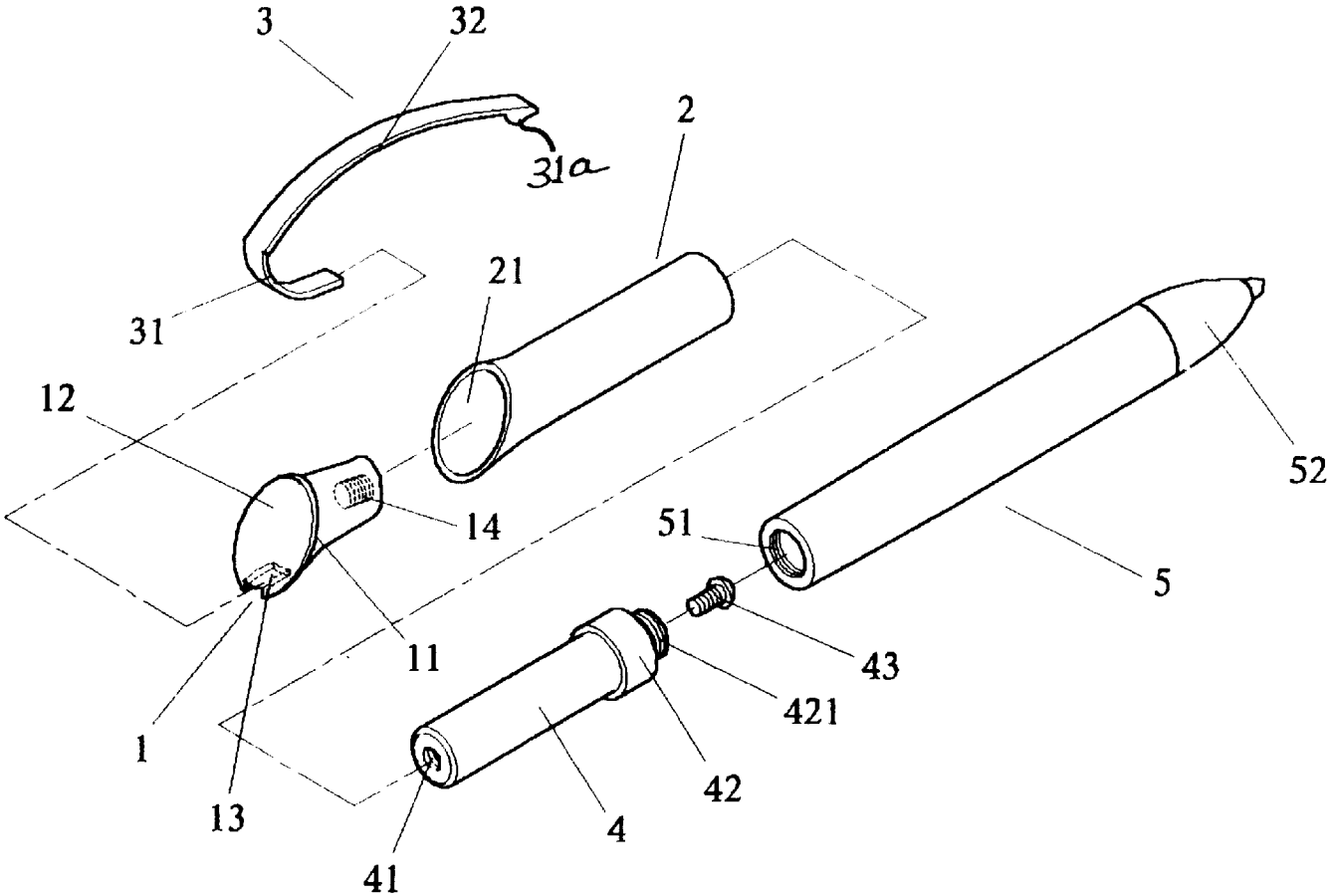
FIG. 2 is a perspective exploded view of the preferred embodiment of the present invention.
Figure 3:
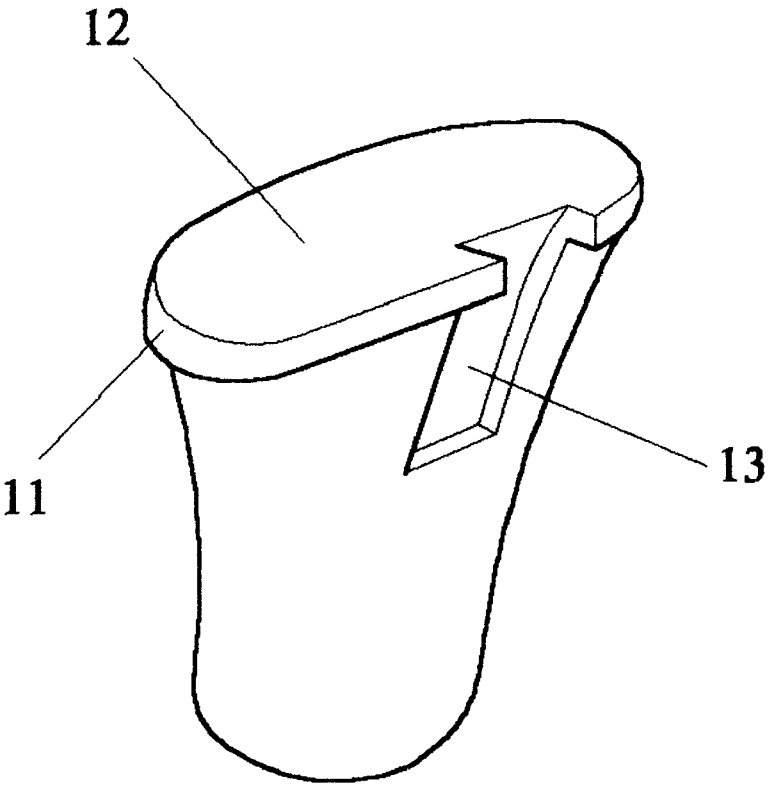
FIG. 3 is a perspective view of a fixing cap of the preferred embodiment of the present invention.
Figure 6B:
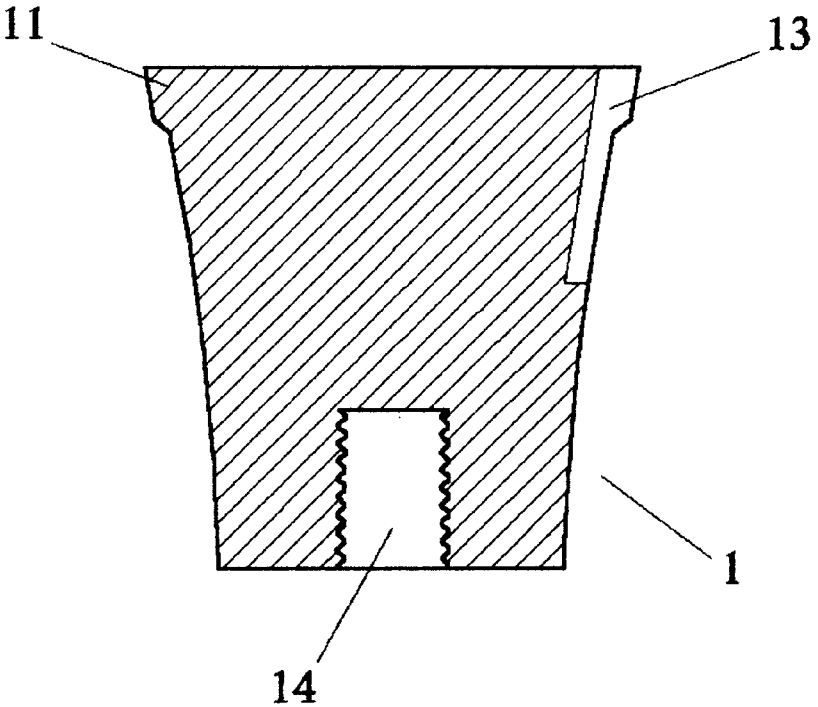
FIG. 6B is a longitudinal section of the fixing cap of another preferred embodiment of the present invention.
Figure 6A:
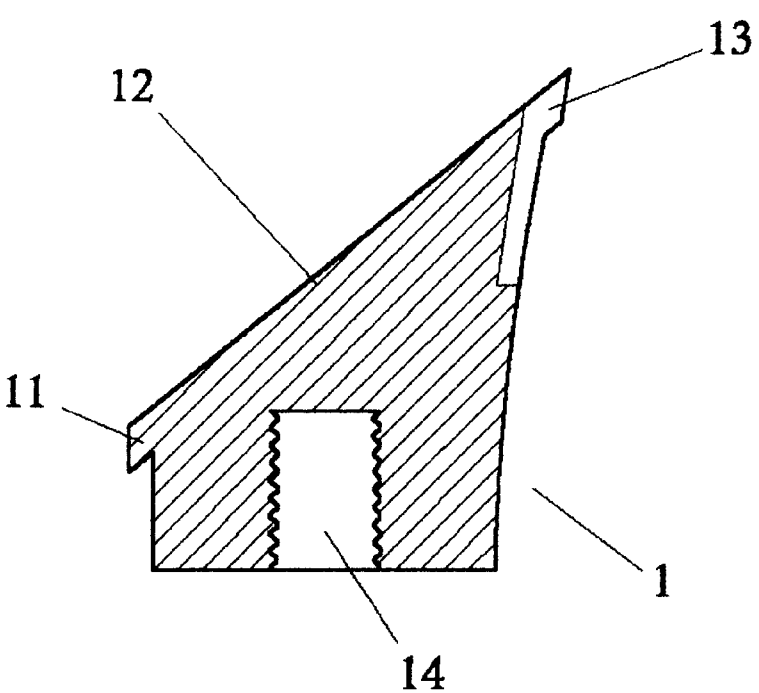
FIG. 6A is a longitudinal section of the fixing cap of the preferred embodiment of the present invention.

FIG. 1 shows a perspective view of a preferred embodiment of the present invention. It's apparent from FIGS. 1 and 2 that the present invention includes at least a fixing cap 1, an upper casing 2, a fixing clip 3, an adjusting assembly 4 and a lower casing 5. The fixing cap 1 has an inclined guiding surface 12 and a flange 11 (see FIG. 3) at the top thereof. An indentation 13 vertically extending along the side of the fixing cap 1 is disposed at the rim of the inclined guiding surface 12. A tapped hole 14 is arranged in the middle lower part of the fixing cap 1. The top of the fixing cap 1 can be constructed as the inclined guiding surface 12 (see FIG. 6A) or the flat surface (see FIG. 6B). The upper casing 2 is a hollow tube and has a trumpet-shaped mouthpiece 21. Alternatively, it can have the conic or pyramidal (wide at the top while narrow at the bottom) form. No matter whether the top surface is flat or sloped, the assembly thereof is applicable and the fixing way is identical. The trumpet-shaped mouthpiece 21 at the top end of the upper casing 2 can exactly receive the fixing cap 1 while the other end thereof is in connection with the adjusting assembly 4. The fixing clip 3 is bent by a metal piece and has a connecting part 31 at one end thereof which is engaged in the indentation 13, and a curved portion 31 a at another end thereof for engaging upper casing 2. A folded rim 32 is formed in a proper position of the fixing clip 3 in order to strengthen the whole structure. Therefore, it won't be easily deformed by an external shock. The adjusting assembly 4 has a female-threaded hole 41 at one end thereof for a screw 43, a flange 42 at the other end thereof for the attachment of the upper casing 2 and a male-threaded projection 421 for the bolted connection with the female thread 51 of the lower casing 5. The lower casing 5 has a conic hollow end while the other end thereof is secured with a fixing seat 52 in such a way that an ink cartridge 53 is only movable in a preset position. A female thread 51 is disposed atop the lower casing 5.

Figure 4B:
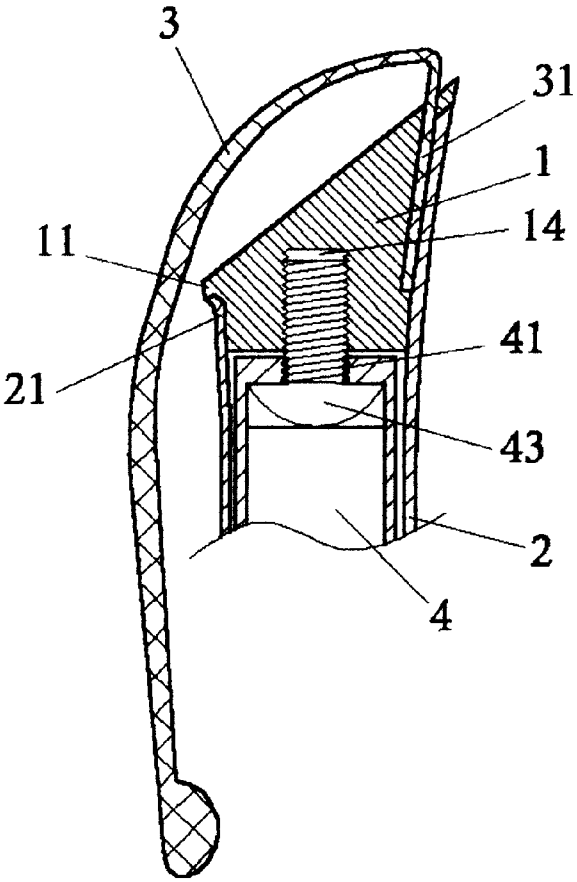
FIGS. 4A and 4B are schematic drawings of the assembly procedure of the preferred embodiment of the present invention.
Figure 4A:
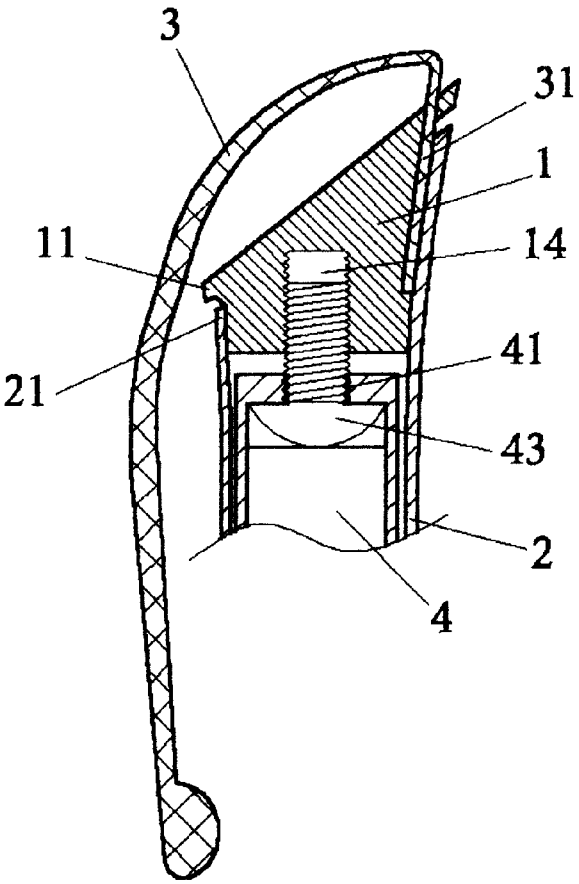
Figure 5:
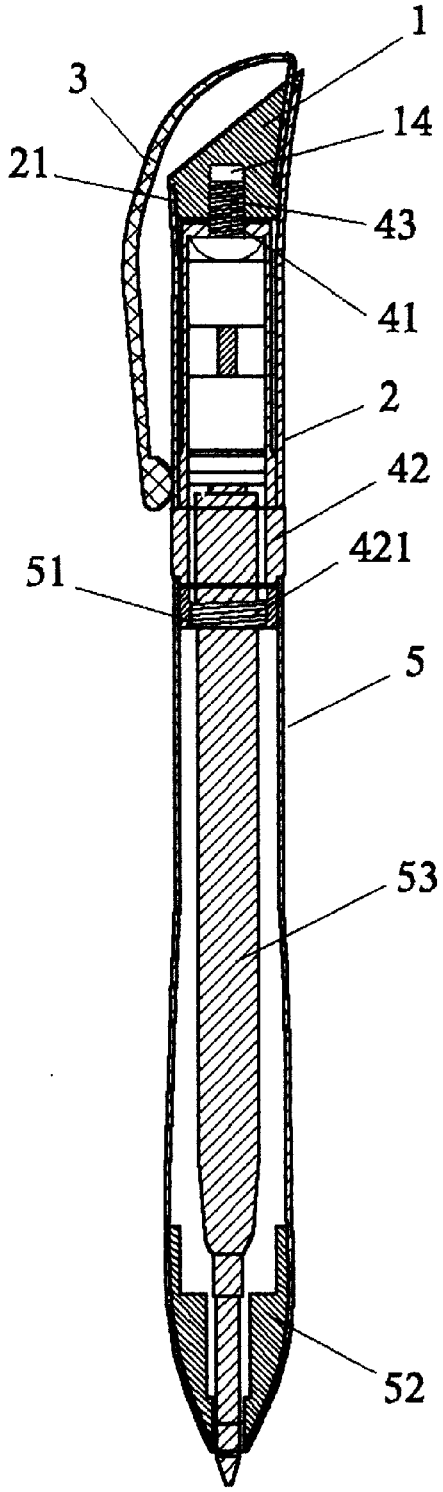
FIG. 5 is a longitudinal section of the preferred embodiment of the present invention.

In assembly, the adjusting assembly 4 with the female-threaded hole 41 is upwardly placed into the upper casing 2. Thereafter, the connecting part 31 of the fixing clip 3 is engaged into the indentation 13 of the fixing cap 1, and the fixing cap 1 together with the fixing clip 3 is placed into the trumpet-shaped mouthpiece 21 of the upper casing 2. A screw 43 passes upwardly through the flange 42 of the adjusting assembly 4 and is secured to the tapped hole 14 at the bottom of the fixing cap 1 (see FIGS. 4A and 4B). Due to the curved design of the fixing clip 3, the clearance between both ends of the fixing clip 3 is smaller than the diameter of the upper casing 2. When the Range 11 of the fixing cap 1 is engaged against the trumpet-shaped mouthpiece 21 of the upper casing 2, the connecting part 31 of the fixing clip 3 is tightly received in the indentation 13 while the other end of the fixing clip 3 leans tightly against the outer side of the upper casing 2 to create an opposite clamping force. The assembly of the above-mentioned components is complete when the male-threaded projection 421 of the adjusting assembly 4 and the female thread 51 inside the lower casing 5 are screwed together (see FIG. 5).

The connecting part 31 of the fixing clip 3 is engaged in the indentation 13 formed between the fixing cap 1 and the upper casing 2. Moreover, the upper casing 2 and the fixing cap 1 have a corresponding sloped conic form and the fixing clip 3 has a special curved design so that the fixing clip 3 creates a proper clamping force on the upper casing 2 and won't be easily disconnected after used for a long period.

The upper casing 2 can be wide at the top and narrow at the bottom, narrow at the top and wide at the bottom or with a universal diameter. Only when the squeezing connection is created between the fixing cap 1 and the casing while the fixing clip 3 is engaged therein, and the screw 43 is used for fixing them, these are included within the range of the present invention.

Many changes and modifications in the above described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A fixing device for a pen clip comprising:

a fixing cap having an inclined guiding surface and a flange at the top thereof, an indentation vertically extending along the side of said fixing cap and being disposed at a rim of said inclined guiding surface;

an upper casing being a hollow tube one end of which is wide at the top and narrow at the bottom thereof;

a fixing clip being bent and made by a metal piece and having a connecting part at one end thereof and another end;

an adjusting assembly having a female-threaded hole at one end thereof and a flange at the other end thereof; and a lower casing having a conic hollow end while the other end thereof is secured with a fixing seat in such a way that an ink cartridge is only movable in a preset position;

wherein respective ends of said fixing cap and said adjusting assembly are threadedly tightly fastened to one another by a screw at an end of said upper casing, and wherein, due to a curved design of said fixing clip, the clearance between both ends of said fixing clip is smaller than the diameter of said upper casing so that, when said flange of said fixing cap is engaged against a trumpet-shaped mouthpiece of said upper casing, said connecting part of said fixing clip is tightly received in said indentation while the another end of said fixing clip leans tightly against an outer side of said upper casing to create an opposite clamping force so said fixing clip will not be easily disconnected, and said upper casing is expanded by the screw for a tight connection with the fixing clip and therefore cannot be easily disconnected after a long period of use.

2. A fixing device for a pen clip as recited in claim 1 wherein a folded rim is formed in a proper position of said fixing clip in order to strengthen the clip so that said fixing clip will not be easily deformed by an external shock.

3. A fixing device for a pen clip as recited in claim 1 wherein said fixing cap is flat at the top there of as an alternative preferred form.

4. A fixing device for a pen clip as recited in claim 1 wherein said upper casing is a hollow tube being wide at the top and narrow at the bottom, narrow at the top and wide at the bottom or with a universal diameter, and wherein said fixing clip has a curved design for an engaging connection with said upper casing; and wherein said fixing cap and said adjusting assembly are utilized for obtaining a clamping resilience and avoiding the disconnection from said fixing cap.

5. A fixing device for a pen clip as recited in claim 1 wherein said upper casing has a pyramidal form.

6. A fixing device for a pen clip as recited in claim 1 wherein said upper casing has a conic form.

7. A fixing device for a pen clip as recited in claim 1 wherein said upper casing has an oval conic form.

* * * * *